US011468854B2

(12) United States Patent
Calayir et al.

(10) Patent No.: US 11,468,854 B2
(45) Date of Patent: Oct. 11, 2022

(54) ADAPTIVE HEADROOM ADJUSTMENT SYSTEMS AND METHODS FOR ELECTRONIC DEVICE DISPLAYS

(71) Applicant: Apple Inc., Cupertino, CA (US)

(72) Inventors: Vehbi Calayir, San Jose, CA (US); James E. Brown, San Jose, CA (US)

(73) Assignee: Apple Inc., Cupertino, CA (US)

( * ) Notice: Subject to any disclaimer, the term of this patent is extended or adjusted under 35 U.S.C. 154(b) by 224 days.

(21) Appl. No.: 16/510,635

(22) Filed: Jul. 12, 2019

(65) Prior Publication Data

US 2020/0090599 A1 Mar. 19, 2020

Related U.S. Application Data

(60) Provisional application No. 62/733,028, filed on Sep. 18, 2018.

(51) Int. Cl.

| | |
|---|---|
| ***G09G 3/34*** | (2006.01) |
| ***G09G 5/10*** | (2006.01) |
| ***G09G 3/282*** | (2006.01) |

(52) U.S. Cl.

CPC ..... *G09G 3/3426* (2013.01); *G09G 3/282* (2013.01); *G09G 5/10* (2013.01); *G09G 2320/062* (2013.01); *G09G 2330/021* (2013.01); *G09G 2360/144* (2013.01); *G09G 2360/16* (2013.01)

(58) Field of Classification Search

CPC .... G09G 3/3426; G09G 3/282; G09G 3/2096; G09G 5/10; G09G 2320/062; G09G 2360/144; G09G 2360/16; G09G 2330/021; G09G 2310/061

See application file for complete search history.

(56) References Cited

U.S. PATENT DOCUMENTS

| | | | | |
|---|---|---|---|---|
| 2010/0289839 | A1* | 11/2010 | Min | G09G 3/3688 345/691 |
| 2012/0044142 | A1* | 2/2012 | Wu | G06F 1/3231 345/158 |
| 2014/0368558 | A1* | 12/2014 | Ikeda | G09G 3/3426 345/690 |
| 2017/0110062 | A1* | 4/2017 | Zhang | G09G 3/3696 |
| 2021/0012720 | A1* | 1/2021 | Kang | G09G 3/3426 |

* cited by examiner

*Primary Examiner* — Chanh D Nguyen
*Assistant Examiner* — Andrew Lee
(74) *Attorney, Agent, or Firm* — Aikin & Gallant, LLP

(57) ABSTRACT

Aspects of the subject technology relate to control circuitry for light-emitting diodes. The control circuitry may include feedforward control and a feedback control for a power supply for the light-emitting diodes. The feedforward control may include host circuitry for the device that determines a maximum zone current, a maximum row current, and the maximum row-to-row current step for an upcoming backlight frame while a current backlight frame is being executed. A headroom voltage for the upcoming backlight frame is determined based on the maximum zone current, the maximum row current, and/or the maximum row-to-row current step and provided to the power supply so that the power supply can settle at a corresponding supply voltage before the upcoming backlight frame is executed. The feedback control utilizes dynamic thresholds determined for each backlight frame to fine tune the feedforward-determined headroom voltage.

19 Claims, 4 Drawing Sheets

ADAPTIVE HEADROOM ADJUSTMENT SYSTEMS AND METHODS FOR ELECTRONIC DEVICE DISPLAYS

RELATED APPLICATIONS

This application claims the benefit of priority of U.S. Provisional Application No. 62/733,028 filed Sep. 18, 2018 which is incorporated herein by reference.

TECHNICAL FIELD

The present description relates generally to electronic devices with displays, and more particularly, but not exclusively, to adaptive headroom adjustment systems and methods for electronic device displays.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Liquid crystal displays commonly include a backlight unit and a liquid crystal display unit with individually controllable liquid crystal display pixels.

The backlight unit commonly includes one or more light-emitting diodes (LEDs) that generate light that exits the backlight toward the liquid crystal display unit. The liquid crystal display pixels are individually operable to control passage of light from the backlight unit through that pixel to display content such as text, images, video, or other content on the display.

SUMMARY OF THE DESCRIPTION

In accordance with various aspects of the subject disclosure, an electronic device is provided that includes host circuitry, a display with a backlight unit, and a power supply configured to provide a supply voltage for the backlight unit. The backlight unit includes an array of light-emitting diodes arranged in rows and columns and a plurality of operable zones. The backlight unit also includes driver circuitry configured to control currents through the columns when the supply voltage is provided, the currents based on display information associated with a current backlight frame. The host circuitry is configured to generate a supply voltage update for the power supply, the supply voltage update configured to include a headroom voltage for an upcoming backlight frame, the headroom voltage based on at least one of a maximum zone current, a maximum row current, or a maximum row-to-row current step for the upcoming backlight frame.

In accordance with other aspects of the subject disclosure, a method is provided that includes operating an array of light-emitting diodes in an electronic device during a current backlight frame, the array of light-emitting diodes including a plurality of rows of light-emitting diodes and individually operable zones that each include at least a portion of at least one of the rows. The method also includes determining, during the current backlight frame, a maximum zone current, a maximum row current, and a maximum row-to-row current step for an upcoming backlight frame. The method also includes determining a supply voltage update for a power supply for the array of light-emitting diodes based on the determined maximum zone current, maximum row current, and maximum row-to-row current step if any of the maximum zone current, the maximum row current, or the maximum row-to-row current step for the upcoming backlight frame is different from a maximum zone current, a maximum row current, or a maximum row current step for the current backlight frame.

In accordance with other aspects of the subject disclosure, an electronic device is provided that includes backlight circuitry configured to operate an array of light-emitting diodes during a current backlight frame, the array of light-emitting diodes including a plurality of rows of light-emitting diodes and individually operable zones that each include at least a portion of at least one of the rows. The electronic device also includes host circuitry configured to determine, during the current backlight frame, a maximum zone current, a maximum row current, and a maximum row-to-row current step for an upcoming backlight frame. The host circuitry is also configured to determine a supply voltage update for a power supply for the array of light-emitting diodes based on the determined maximum zone current, maximum row current, and maximum row-to-row current step if any of the maximum zone current, the maximum row current, or the maximum row-to-row current step for the upcoming backlight frame is respectively different from a maximum zone current, a maximum row current, or a maximum row current step for the current backlight frame.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
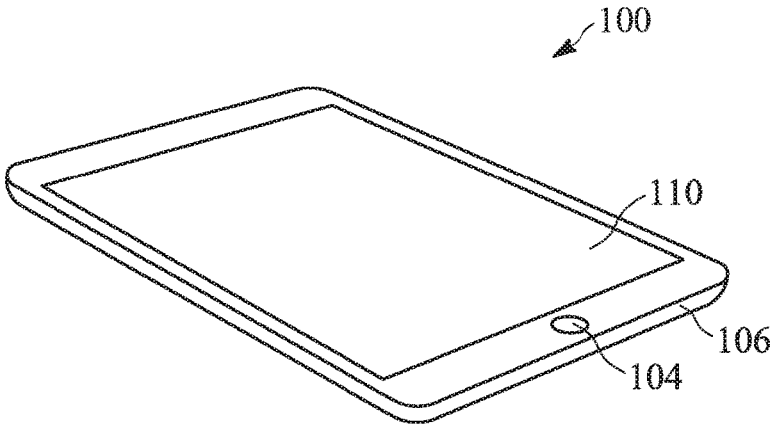
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, tablet computers, laptop computers, set-top boxes, smart watches, wireless access points, and other electronic equipment that include light-emitting diode arrays such as in backlight units of displays. Displays are used to present visual information and status data and/or may be used to gather user input data. A display includes an array of display pixels. Each display pixel may include one or more colored subpixels for displaying color images.

Each display pixel may include a layer of liquid crystals disposed between a pair of electrodes operable to control the orientation of the liquid crystals. Controlling the orientation of the liquid crystals controls the polarization of backlight from a backlight unit of the display. This polarization control, in combination with polarizers on opposing sides of the liquid crystal layer, allows light passing into the pixel to be manipulated to selectively block the light or allow the light to pass through the pixel.

The backlight unit includes one or more light-emitting diodes (LEDs) such as one or more strings and/or arrays of light-emitting diodes that generate the backlight for the display. In various configurations, strings of light-emitting diodes may be arranged along one or more edges of a light guide plate that distributes backlight generated by the strings to the LCD unit, or may be arranged to form a two-dimensional array of LEDs.

Although examples discussed herein describe LEDs included in display backlights, it should be appreciated that the LED control circuitry and methods described herein can be applied to LEDs implemented in other devices or portions of a device (e.g., in a backlit keyboard or a flash device).

Backlight (BL) control circuitry for the backlight unit includes backlight row drivers and backlight column drivers that control one or more light-emitting diodes (LEDs) such as an array of LEDs arranged in LED rows and LED columns. The backlight control circuitry also includes a backlight controller (BCON) communicatively coupled to the backlight row drivers and the backlight column drivers. Based on control signals from the BCON, the backlight row drivers and backlight column drivers can operate various portions of the array of LEDs to provide a desired amount of backlight for the LCD pixels, to generate desired display content in various zones of the display.

During operation, a power supply maintains a supply voltage for each column of LEDs that is sufficiently high to maintain a headroom voltage at the end of each column. The headroom voltage is set to ensure sufficient power to operate all LEDs in all columns at a desired brightness. To avoid steady state power loss due to unnecessarily high headroom voltages, it can be desirable to dynamically adjust headroom voltages during operation of the LEDs. However, it can be challenging to provide this type of dynamic headroom adjustment on a frame-by-frame basis due to the settling time for the power supply that provides the supply voltage.

In accordance with various aspects of the subject disclosure, backlight control circuitry is provided with a feedforward (coarse tuning) control and a feedback (fine tuning) control for LED headroom voltage that allows frame-by-frame headroom control for power saving. The feedforward coarse control is performed based on a maximum zone current, a maximum row current, and a maximum row-to-row current step for an upcoming backlight frame to be executed after a backlight frame that is presently being executed. The feedback fine tuning is performed based on comparisons of actual headroom voltages with dynamic headroom thresholds that are based on a maximum zone current and a maximum row-to-row current step for the backlight frame presently being executed.

An illustrative electronic device having light-emitting diodes is shown in FIG. 1. In the example of FIG. 1, device 100 has been implemented using a housing that is sufficiently small to be portable and carried by a user (e.g., device 100 of FIG. 1 may be a handheld electronic device such as a tablet or a cellular telephone). As shown in FIG. 1, device 100 may include a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 may include display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using LCD pixels and LED backlights are sometimes described herein as an example. This is, however, merely illustrative. In various implementations, any suitable type of display technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations. An LED backlight array may also be provided for the keyboard and/or other illuminated portions of device 100.

In some implementations, electronic device 100 may be provided in the form of a computer integrated into a computer monitor. Display 110 may be mounted on a front surface of housing 106 and a stand may be provided to support housing (e.g., on a desktop).

Figure 2:
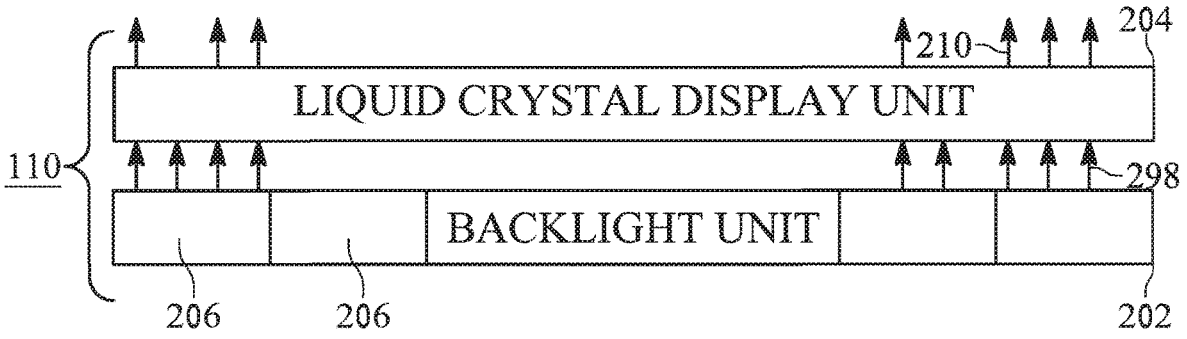
FIG. 2 illustrates a block diagram of a side view of an electronic device display having a backlight unit in accordance with various aspects of the subject technology.

FIG. 2 is a schematic diagram of display 110 in which the display is provided with a liquid crystal display unit 204 and a backlight unit 202. As shown in FIG. 2, backlight unit 202 generates backlight 298 and emits backlight 298 in the direction of liquid crystal display unit 204. Liquid crystal display unit 204 selectively allows some or all of the backlight 298 to pass through the liquid crystal display pixels therein to generate display light 210 visible to a user. Backlight unit 202 includes one or more subsections 206.

In some implementations, subsections 206 may be elongated subsections that extend horizontally or vertically across some or all of display 110 (e.g., in an edge-lit configuration for backlight unit 202). In other implementations, subsections 206 may be square or other rectilinear subsections (e.g., subarrays of a two-dimensional LED array backlight). Accordingly, subsections 206 may be defined by one or more strings and/or arrays of LEDs disposed in that subsection. Subsections 206 may define operable zones of BLU 202 that can be controlled individually for local dimming of backlight 298.

Although backlight unit 202 is shown implemented with a liquid crystal display unit, it should be appreciated that a backlight unit such as backlight unit 202 may be implemented in a backlit keyboard, or to illuminate a flash device or otherwise provide illumination for an electronic device.

Figure 3:
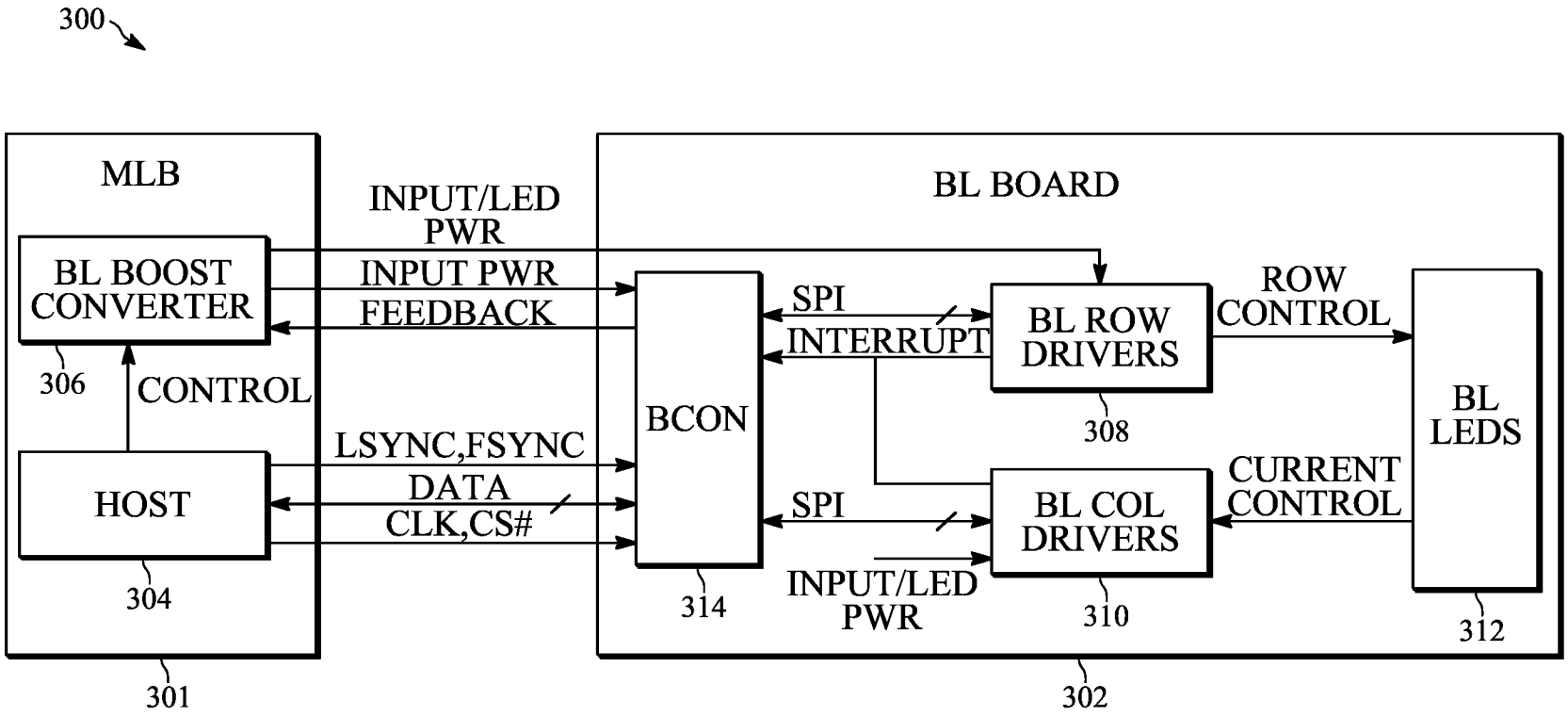
FIG. 3 illustrates a schematic diagram of light-emitting diode (LED) control circuitry having feedforward and feedback based headroom control in accordance with various aspects of the subject technology.

FIG. 3 shows a schematic diagram of exemplary circuitry for electronic device 100 including host circuitry and LED circuitry such as backlight circuitry for display 110. For example, device circuitry 300 of FIG. 3 may include a backlight board 302 that can be implemented in backlight unit 202 or other LED lighting devices.

In the example of FIG. 3, device circuitry 300 includes a main logic board (MLB) 301 having host circuitry 304 and includes backlight circuitry that includes backlight controller 314, backlight row drivers 308, backlight column drivers 310, and backlight LEDs 312. As shown, LEDs 312 are operated by BL row drivers 308 and BL column driver 310 based on commands from backlight controller 314. In this example, backlight controller 314, backlight row drivers 308, backlight column drivers 310, and backlight LEDs 312 are implemented on a common backlight board 302. The backlight controller 314, backlight row drivers 308, and backlight column drivers 310 can communicate via a communication protocol (e.g., synchronous serial communication (SPI)). The backlight row drivers 308 and backlight column drivers 310 can send interrupt signals to the backlight controller 314 for specific interrupt conditions. Backlight controller 314 receives control signals from host circuitry 304.

In the example of FIG. 3, a power supply for backlight unit 202 is provided on MLB 301. In this example, the power supply for backlight unit 202 is implemented as a boost converter 306 mounted on the same MLB as host circuitry 304. However, it should be appreciated that the power supply may be any DC/DC converter with a programmable output voltage. The boost converter 306 provides input power to the backlight controller 314 and also provides input/LED power to the backlight row drivers 308 and backlight column drivers 310.

Host circuitry 304 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in host circuitry 304. Processing circuitry in host circuitry 304 may be used in controlling the operation of device 100. Processing circuitry in host circuitry 304 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, host circuitry 304 may be used to run software for device 100, such as internet browsing applications, email applications, media playback applications, operating system functions, etc.

During operation of device 100, host circuitry 304 may generate or receive data that is to be displayed on display 110 (see, FIGS. 1 and 2). This display data may be processed and/or provided to display control circuitry such as a graphics processing unit (GPU) for LCD unit 204. For example, display frames, including display pixel values (e.g., each corresponding to a grey level) for display using pixels of LCD unit 204 (e.g., colored subpixels such as red, green, and blue subpixels) may be provided from host circuitry 304 to a GPU. The GPU may process the display frames and provide processed display frames to a timing controller integrated circuit for LCD unit 204.

As shown in FIG. 3, host circuitry 304 also provides control signals to backlight circuitry for operation of backlight LEDs 312. As shown, the control signals may include synchronization signals such as line synchronization (LSYNC) signals and frame synchronization (FSYNC) signals and clock signals (CLK, CS #) for synchronizing operation of backlight LEDs 312 with the operation of LCD pixels for LCD unit 204.

Host circuitry 304 also provides data to backlight controller 314 for operation of LEDs 312 in zones 206 to spatially and temporally coordinate operation of LEDs 312 with the content being generated by the LCD pixels for each display frame. The data provided from host circuitry 304 to backlight controller 314 is based on display content to be displayed in each display frame. Thus, the host circuitry 304 and backlight controller can communicate via multiple high speed data links (e.g., 2).

As shown, backlight controller 314 also provides feedback data to host circuitry 304. The feedback data provided from backlight controller 314 to host circuitry 304 may include headroom feedback information for each column of LEDs 312. For example, the headroom feedback information may include actual headroom voltage samples and/or up/down commands generated at BL board 302 (e.g., by column drivers 310 or BCON 314 based on sampled residual voltages at the end of each string of LEDs) for each column of LEDs 312. An up command for a column or string of LEDs 312 indicates that the headroom voltage for that column or string should be increased. A down command for a column or string of LEDs 312 indicates that the headroom voltage for that column or string can be reduced to save power. These up/down feedback commands may be generated by two comparators (e.g., an up comparator and a down comparator) for each LED channel and may create a feedback loop for fine tuning of headroom voltages. However, it should be appreciated that the feedback information such as variable-sized up or down commands may be generated by an ADC (analog-to-digital converter).

Host circuitry 304 and/or BCON 314 may collect up/down commands from all LED drivers (e.g., column drivers 310) and combine the collected up/down commands into a single command to boost converter 306 for fine-tuning of the headroom for power savings during display of static images or other static content. This fine-tuning feedback operation may be performed between coarse tuning updates that are made to the boost converter output based on feedforward information for a next or other upcoming backlight frame. Host circuitry 304 and/or BCON 314 may implement a keep-out time for the feedback fine-tuning up/down commands to be applied to the headroom adjustment to avoid conflict between the feedforward coarse adjustment and the fine-tuning feedback operations. For example, host circuitry 304 may ignore the first fine-tuning feedback command after each coarse tuning update.

The feedforward coarse tuning updates provide an early warning to the boost converter that allows the boost converter time to settle before the new output from the boost converter is needed by LEDs 312 for a next or other upcoming backlight frame. Control signals that are provided from host circuitry 304 to boost converter 306 for feedforward coarse headroom tuning are generated based on a maximum LED zone current, a maximum LED row current, and a maximum row-to-row current step for an upcoming backlight frame. The maximum LED zone current facilitates a headroom adjustment to account for LED driver and/or circuit board IR drops and/or LED forward voltage variations. The maximum LED row current facilitates a headroom adjustment to account for gate driver and/or circuit board IR drops. The maximum row-to-row current step facilitates a headroom adjustment for boost converter undershoot.

Host circuitry 304 determines the maximum LED zone current, the maximum LED row current, and the maximum row-to-row current step and then determines a new headroom voltage for the upcoming backlight frame based on the maximum LED zone current, the maximum LED row current, and the maximum row-to-row current step for the upcoming backlight frame as further described hereinafter in connection with, for example, FIGS. 4 and 5.

Figure 4:
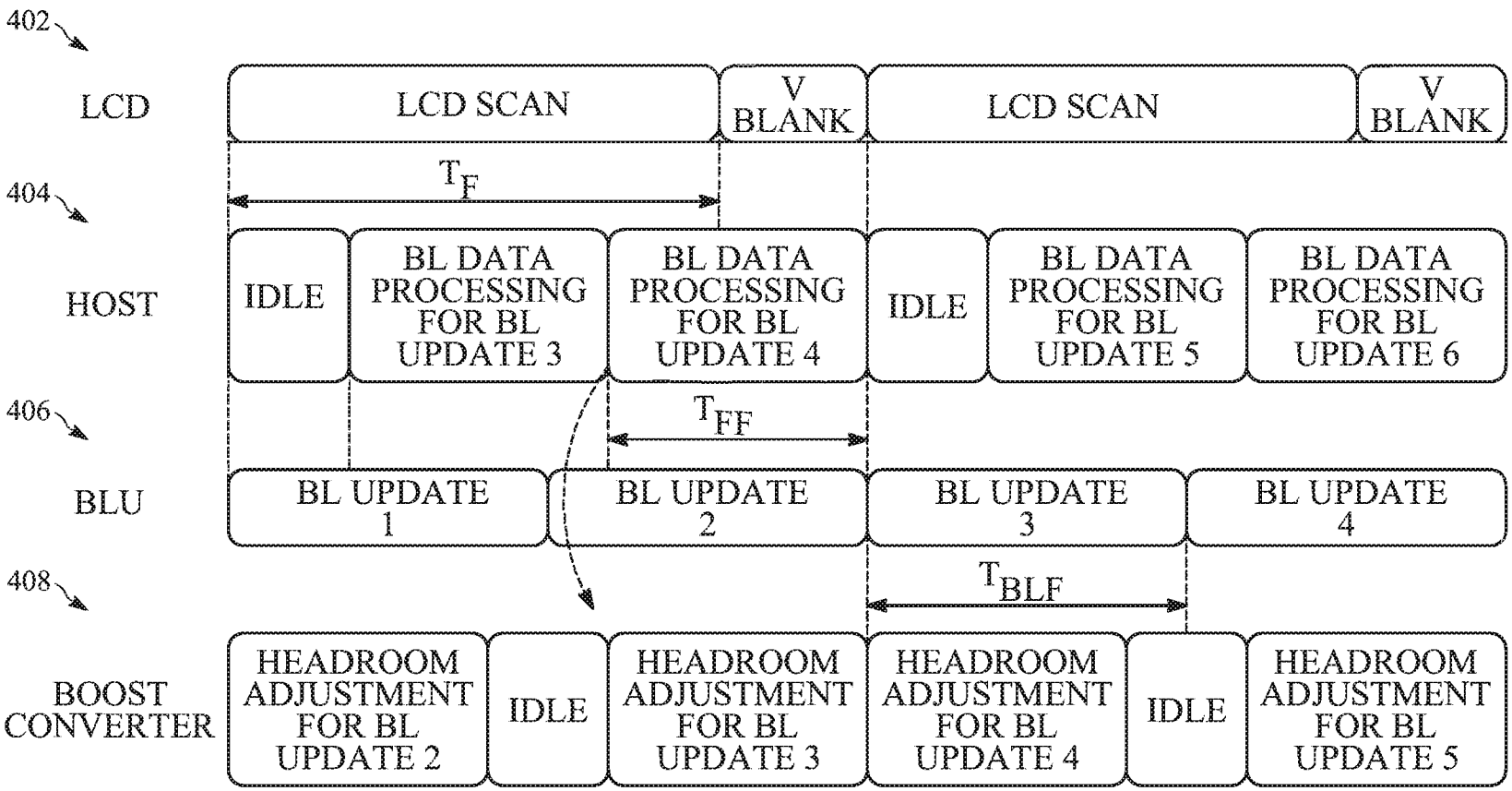
FIG. 4 illustrates a schematic timing diagram for feedforward LED headroom control in accordance with various aspects of the subject technology.

FIG. 4 is a timing diagram that illustrates an LCD timeline 402, a host timeline 404, a backlight unit (BLU) timeline 406, and a boost controller timeline 408. FIG. 4 illustrates how host circuitry 304 determines the new headroom voltage for an upcoming BL update 3 while boost converter 306 is performing a headroom adjustment for the next backlight update 2, and while the present backlight update 1 is being executed.

In this way, the upcoming headroom for backlight update (frame) 3 is determined, and the determined headroom is applied, before backlight frame 3 is executed at the LEDs 312 to allow the boost converter time to settle before that frame is executed.

As shown, in some operational scenarios, for each LCD scan having a frame time $T_F$, backlight unit 202 can execute one or more (e.g., two) backlight updates (frames), each having a backlight frame time $T_{BLF}$ that is equal to or longer than the feedforward data processing time $T_{FF}$ for host circuitry 304 to determine the headroom adjustment for that backlight frame.

Figure 5:
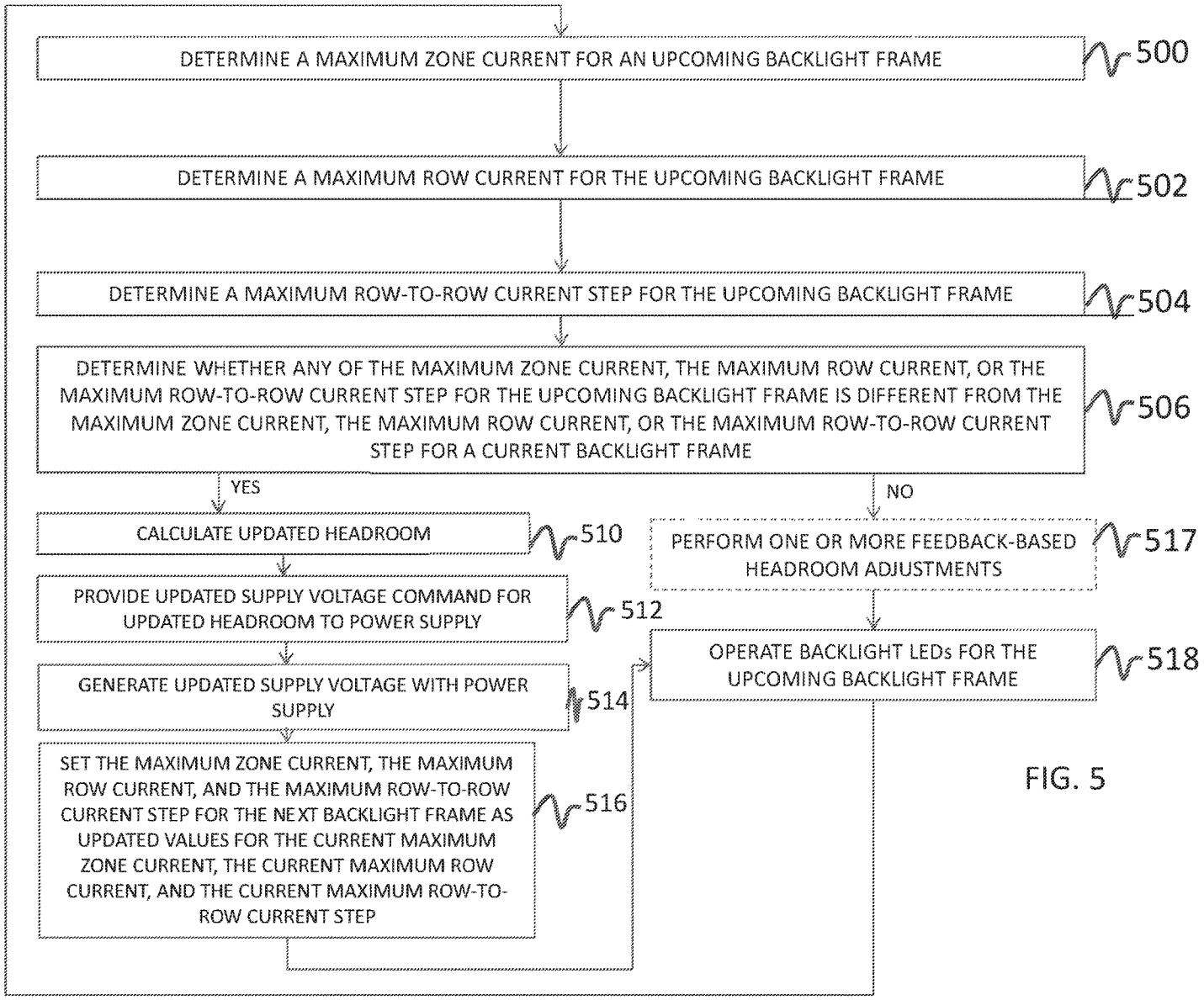
FIG. 5 is a flow chart of illustrative operations that may be performed light-emitting diode control in accordance with various aspects of the subject technology.

FIG. 5 depicts a flow chart of an example process for headroom control for LED circuitry in accordance with various aspects of the subject technology. For explanatory purposes, the example process of FIG. 5 is described herein with reference to the components of FIGS. 1, 2, and 3. Further for explanatory purposes, the blocks of the example process of FIG. 5 are described herein as occurring in series, or linearly. However, multiple blocks of the example process of FIG. 5 may occur in parallel. In addition, the blocks of the example process of FIG. 5 need not be performed in the order shown and/or one or more of the blocks of the example process of FIG. 5 need not be performed.

In the depicted example flow diagram, at block 500, host circuitry 304 determines a maximum zone current for an upcoming backlight frame. The host circuitry may generate or receive display data that is to be displayed on display 110 by cooperative operation of the pixels of LCD unit 204 and the LEDs 312 of BLU 202. The display data includes display content for display during an upcoming display frame by the pixels of the LCD, as backlit by the LEDs 312 of BLU 202 during one or more backlight frames (including the upcoming backlight frame) that occur during the upcoming display frame. The host circuitry may generate backlight control data for operating one or more zones of the BLU to generate the backlight according to the display content. The host circuitry may determine the maximum zone current for the upcoming backlight frame by determining the expected current in each zone for that backlight frame, and determining the maximum of the expected zone currents.

At block 502, host circuitry 304 determines a maximum row current for the upcoming backlight frame. The maximum row current may be determined by determining an expected current for each row of LEDs 312 for generating the backlight for the display content during the upcoming backlight frame, and determining the maximum of the expected row currents.

At block 504, host circuitry 304 determines a maximum row-to-row current step for the upcoming backlight frame. The maximum row-to-row current step may be determined by determining an expected current step between each row of LEDs 312 and the next row of LEDs 312 to be operated for generating the backlight for the display content during the upcoming backlight frame, and determining the maximum of the expected current steps. The next row of LEDs may be an adjacent row or another row if the rows of LEDs are operated in a non-sequential order.

At block 506, host circuitry 304 determines whether any of the maximum zone current, the maximum row current, or the maximum row-to-row current step for the upcoming backlight frame is different from the present value for that parameter (e.g., different respectively from the maximum zone current, the maximum row current, or the maximum row current step for a current backlight frame).

If it is determined that any of the maximum zone current, the maximum row current, or the maximum row-to-row current step for the upcoming backlight frame is different from the present value for that parameter, at block 510, host circuitry 304 calculates an updated headroom voltage to be provided by boost converter 306 during the upcoming backlight frame. Host circuitry 304 calculates the updated headroom voltage by (i) obtaining a zone headroom voltage, a row headroom voltage, and a step headroom voltage corresponding to the determined maximum zone current, the maximum row current, and the maximum row-to-row current step (e.g., from lookup table(s) that store headroom voltages for each of several values or ranges of the maximum zone current, the maximum row current, or the maximum row-to-row current step), and (ii) combining (e.g., adding) the zone headroom voltage, the row headroom voltage, and the step headroom voltage to generate the updated headroom voltage. In this way, the updated headroom voltage provides sufficient headroom to account for column driver and/or circuit board IR drops and LED forward voltage variations (e.g., the zone headroom voltage), row driver and/or circuitry board IR drops (e.g., the row headroom voltage), and boost undershoot (e.g., the step headroom voltage).

At block 512, host circuitry 304 provides an updated supply voltage command for the updated headroom voltage to boost converter 306. The updated supply voltage command causes boost converter 306 to generate an updated supply voltage that includes the updated headroom voltage.

At block 514, boost converter 306 generates the updated supply voltage including the updated headroom voltage responsive to the updated supply voltage command from host circuitry 304. Because the host circuitry generates the updated supply voltage command for the updated headroom voltage before the upcoming backlight frame is executed, boost converter 306 is provided with time to settle at the updated supply voltage before the backlight LEDs are operated for use in the next feedforward headroom update operation.

At block 516, host circuitry 304 sets the maximum zone current, the maximum row current, and the maximum row-to-row current step for the next or upcoming backlight frame as updated values for the current maximum zone current, the current maximum row current, and the current maximum row-to-row current step for use in the next feedforward headroom update operation.

As shown in FIG. 5, if it is determined at block 506 that all of the maximum zone current, the maximum row current, and the maximum row-to-row current step for the upcoming backlight frame are the same as the present value for that parameter, BCON 314 can operate the backlight LEDs (block 518) for the upcoming backlight frame without a coarse (feedforward) adjustment to the headroom voltage.

FIG. 5 also shows how, when the coarse (feedforward) adjustment has not been made for a last backlight frame (e.g., when static content is displayed), one or more feedback-based headroom adjustments can be made at block 517. Feedback-based headroom adjustments that may be performed at block 517 include combining (e.g., with BCON 314) headroom data from all BL column drivers 310 to form a single up/down command to be provided to host circuitry 304. Host circuitry 304 provides the feedback-based up/down command to boost converter 306 if a keep-out time for making the coarse (feedforward) adjustment has passed (e.g., if no feedforward adjustment was made for the last backlight frame).

The headroom data from all BL column drivers 310 may include residual/headroom voltages that are sampled by BL column drivers 310 from the ends of each column of LEDs during a current backlight frame. BL column drivers 310 and/or BCON 314 may compare each sampled residual voltage to one or more thresholds to determine an up command or down command associated with that sampled voltage. For example, backlight column drivers 310 may be provided with an up comparator and a down comparator, each having a dynamic threshold to which each sampled voltage is compared. For example, the up comparator may have a threshold that is dynamically set based on (e.g., equal to) the maximum zone current headroom voltage for a current backlight frame. For example, the down comparator may have a threshold that is greater than the up comparator threshold by a difference that is dynamically set based on (e.g., equal to) the row-to-row current step headroom for the current backlight frame (e.g., the boost undershoot headroom for the boost converter).

In this way, the feedback-based headroom adjustments can fine tune the output of boost converter 306 to the desired supply voltage that was determined using the feedforward operations of blocks 500, 502, 504, 506, 510, 512, and 514.

By performing the operations described in connection with FIG. 5, host circuitry 304, boost converter 306, and the backlight circuitry cooperate to set and achieve a backlight headroom that ensures sufficient power to operate all backlight LEDs, avoids transients, and reduces power loss due to excess unused voltage.

In accordance with various aspects of the subject disclosure, an electronic device is provided that includes host circuitry, a display with a backlight unit, and a power supply configured to provide a supply voltage for the backlight unit. The backlight unit includes an array of light-emitting diodes arranged in rows and columns and a plurality of operable zones. The backlight unit also includes driver circuitry configured to control currents through the columns when the supply voltage is provided, the currents based on display information associated with a current backlight frame. The host circuitry is configured to generate a supply voltage update for the power supply, the supply voltage update configured to include a headroom voltage for an upcoming backlight frame, the headroom voltage based on at least one of a maximum zone current, a maximum row current, or a maximum row-to-row current step for the upcoming backlight frame.

In accordance with other aspects of the subject disclosure, a method is provided that includes operating an array of light-emitting diodes in an electronic device during a current backlight frame, the array of light-emitting diodes including a plurality of rows of light-emitting diodes and individually operable zones that each include at least a portion of at least one of the rows. The method also includes determining, during the current backlight frame, a maximum zone current, a maximum row current, and a maximum row-to-row current step for an upcoming backlight frame. The method also includes determining a supply voltage update for a power supply for the array of light-emitting diodes based on the determined maximum zone current, maximum row current, and maximum row-to-row current step if any of the maximum zone current, the maximum row current, or the maximum row-to-row current step for the upcoming backlight frame is different from a maximum zone current, a maximum row current, or a maximum row current step for the current backlight frame.

In accordance with other aspects of the subject disclosure, an electronic device is provided that includes backlight circuitry configured to operate an array of light-emitting diodes during a current backlight frame, the array of light-emitting diodes including a plurality of rows of light-emitting diodes and individually operable zones that each include at least a portion of at least one of the rows. The electronic device also includes host circuitry configured to determine, during the current backlight frame, a maximum zone current, a maximum row current, and a maximum row-to-row current step for an upcoming backlight frame. The host circuitry is also configured to determine a supply voltage update for a power supply for the array of light-emitting diodes based on the determined maximum zone current, maximum row current, and maximum row-to-row current step if any of the maximum zone current, the maximum row current, or the maximum row-to-row current step for the upcoming backlight frame is respectively different from a maximum zone current, a maximum row current, or a maximum row current step for the current backlight frame.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa.

Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device, comprising:

host circuitry;

a display with a backlight unit; and a power supply configured to provide a supply voltage for the backlight unit, wherein the backlight unit comprises:

an array of light-emitting diodes arranged in rows and columns and including a plurality of operable zones; and driver circuitry configured to control currents through the columns when the supply voltage is provided, the currents based on display information associated with a current backlight frame, wherein the host circuitry is configured to generate a supply voltage update for the power supply, the supply voltage update configured to include a headroom voltage for an upcoming backlight frame, the headroom voltage based on at least one of a maximum zone current comprised of a maximum of currents expected to be applied to any of the plurality of operable zones during the upcoming backlight frame, a maximum row current comprised of a maximum of all expected currents associated with all rows during the upcoming backlight frame, or a maximum row-to-row current step comprised of an expected maximum current step between two rows in the array of light-emitting diodes for the upcoming backlight frame, wherein the power supply is configured to generate an intervening supply voltage update based on an intervening headroom voltage for an intervening backlight frame while the host circuitry generates a supply voltage update for the upcoming backlight frame and while the driver circuitry controls the currents for the current backlight frame.

2. The electronic device of claim 1, wherein the host circuitry is configured to generate the supply voltage update for the upcoming backlight frame while the driver circuitry controls the currents for the current backlight frame, wherein the intervening supply voltage update for the intervening backlight frame occurs prior to the supply voltage update for the upcoming backlight frame.

3. The electronic device of claim 1, wherein the power supply is a DC/DC converter with a programmable output voltage.

4. The electronic device of claim 3, wherein the host circuitry and the power supply are disposed on a main logic board that is separate from the driver circuitry and the array of light-emitting diodes.

5. The electronic device of claim 1, further comprising a liquid crystal display unit, wherein the display information associated with the current backlight frame includes backlight data that corresponds to display content in a display frame to be displayed by the liquid crystal display unit.

6. The electronic device of claim 5, wherein the driver circuitry is configured to control the currents for the current backlight frame while the display content for the display frame is displayed by the liquid crystal display unit.

7. The electronic device of claim 1, wherein the host circuitry is configured to determine the maximum zone current, the maximum row current, and the maximum row-to-row current step for the upcoming backlight frame based on display content in an upcoming display frame associated with the upcoming backlight frame.

8. The electronic device of claim 7, wherein the host circuitry is configured to compare the maximum zone current, the maximum row current, and the maximum row-to-row current step for the upcoming backlight frame, respectively, to a maximum zone current, a maximum row current, and a maximum row-to-row current step for the current backlight frame.

9. The electronic device of claim 8, wherein the host circuitry is configured to determine the headroom voltage for the upcoming backlight frame based on a first lookup table value corresponding to the maximum zone current, a second lookup table value corresponding to the maximum row current, and a third lookup table value corresponding to the maximum row-to-row current step if any of the maximum zone current, the maximum row current, and the maximum row-to-row current step for the upcoming backlight frame are respectively different from the maximum zone current, the maximum row current, and maximum row-to-row current step for the current backlight frame.

10. The electronic device of claim 8, wherein the host circuitry is configured to provide display information associated with the upcoming backlight frame to a backlight controller without generating the supply voltage update or by generating a fine-tuning supply voltage update based on up or down commands from a backlight controller if all of the maximum zone current, the maximum row current, and the maximum row-to-row current step for the upcoming backlight frame are respectively the same as the maximum zone current, the maximum row current, and maximum row-to-row current step for the current backlight frame.

11. The electronic device of claim 10, wherein the backlight controller comprises a comparator or an analog-to-digital converter that provides the up or down commands.

12. The electronic device of claim 1, wherein the driver circuitry is configured to sample a plurality of headroom voltages from the array of light-emitting diodes during the current backlight frame, and wherein the host circuitry is further configured to receive a feedback-based supply voltage update from a backlight controller coupled to the driver circuitry.

13. The electronic device of claim 12, wherein the supply voltage update comprises a feedforward supply voltage update, and wherein the host circuitry is configured to provide a command to the power supply to generate the feedback-based supply voltage update if a keep-out window following a most recent feedforward supply voltage update has passed and if all of the maximum zone current, the maximum row current, and the maximum row-to-row current step for the upcoming backlight frame are respectively the same as the maximum zone current, the maximum row current, and maximum row-to-row current step for the current backlight frame.

14. A method, comprising:

operating an array of light-emitting diodes in an electronic device during a current backlight frame, the array of light-emitting diodes comprising a plurality of rows of the light-emitting diodes and individually operable zones that each include at least a portion of at least one of the rows;

determining, during the current backlight frame, a maximum zone current of the individually operable zones based on an expected zone current comprised of a maximum of currents expected to be applied to any of a plurality of operable zones for an upcoming backlight frame, determining a maximum row current comprised of a maximum of all expected currents associated with all of the plurality of rows for the upcoming backlight frame, and determining a maximum row-to-row current step comprised of an expected maximum current step between two rows in the array of light-emitting diodes for the upcoming backlight frame; and determining a supply voltage update for a power supply for the array of light-emitting diodes based on the determined maximum zone current, maximum row current, and maximum row-to-row current step if any of the maximum zone current, the maximum row current, or the maximum row-to-row current step for the upcoming backlight frame is different from a maximum zone current, a maximum row current, or a maximum row current step for the current backlight frame.

15. The method of claim 14, wherein determining the supply voltage update for the power supply comprises obtaining a first headroom voltage corresponding to the maximum zone current, a second headroom voltage corresponding to the maximum row current, and a third headroom voltage corresponding to the maximum row-to-row current step for the upcoming backlight frame from at least one lookup table stored by the electronic device.

16. The method of claim 15, wherein determining the supply voltage update for the power supply further comprises combining the first headroom voltage, the second headroom voltage, and the third headroom voltage to generate a headroom voltage update for inclusion in the supply voltage update.

17. The method of claim 14, further comprising sampling, with driver circuitry for the array of light-emitting diodes, a plurality of headroom voltages during the current backlight frame.

18. The method of claim 17, further comprising generating a feedback-based supply voltage update based on a combination of the plurality of headroom voltages.

19. An electronic device, comprising:

backlight circuitry configured to operate an array of light-emitting diodes during a current backlight frame, the array of light-emitting diodes comprising a plurality of rows of light-emitting diodes and individually operable zones that each include at least a portion of at least one of the rows; and host circuitry configured to:

determine, during the current backlight frame, a maximum zone current of the individually operable zones based on an expected zone current for each zone for an upcoming backlight frame, the maximum zone current comprised of a maximum of the currents expected to be applied to any of the plurality of operable zones during the upcoming backlight frame, determining a maximum row current for the plurality of rows for the upcoming backlight frame, the maximum row current comprised of a maximum of all expected currents associated with all rows during the upcoming backlight frame, and determining a maximum row-to-row current step between two rows in the array of light-emitting diodes for the upcoming backlight frame, the maximum row-to-row current step comprised of an expected maximum current step between two rows in the array of light-emitting diodes during the upcoming backlight frame; and determine a supply voltage update for a power supply for the array of light-emitting diodes based on the determined maximum zone current, maximum row current, and maximum row-to-row current step if any of the maximum zone current, the maximum row current, or the maximum row-to-row current step for the upcoming backlight frame is respectively different from a maximum zone current, a maximum row current, or a maximum row current step for the current backlight frame.

* * * * *